US008544823B2

(12) United States Patent
Imberi

(10) Patent No.: US 8,544,823 B2
(45) Date of Patent: Oct. 1, 2013

(54) STORAGE LIFT

(76) Inventor: Trent Imberi, Waconia, MN (US)

( * ) Notice: Subject to any disclaimer, the term of this patent is extended or adjusted under 35 U.S.C. 154(b) by 15 days.

(21) Appl. No.: 13/371,101

(22) Filed: Feb. 10, 2012

(65) Prior Publication Data

US 2013/0207059 A1 Aug. 15, 2013

(51) Int. Cl.
*B66D 1/36* (2006.01)

(52) U.S. Cl.
USPC ..... 254/338; 254/383

(58) Field of Classification Search
USPC ..... 254/278, 286, 338, 383
See application file for complete search history.

(56) References Cited

U.S. PATENT DOCUMENTS

| | | | | |
|---|---|---|---|---|
| 3,556,320 | A | 1/1971 | Henderson | |
| 4,600,177 | A | 7/1986 | Fritz | |
| 5,871,070 | A * | 2/1999 | Contreras | 187/263 |
| 5,897,104 | A | 4/1999 | Garbiso | |
| 6,056,274 | A * | 5/2000 | Naas et al. | 254/335 |
| 6,152,427 | A | 11/2000 | Hoslett | |
| 6,237,781 | B1 | 5/2001 | Dahl | |
| 6,507,962 | B2 * | 1/2003 | Thurston | 5/10.1 |
| 6,959,918 | B1 * | 11/2005 | Samuels | 254/338 |
| 7,014,172 | B2 * | 3/2006 | Kataoka | 254/338 |
| 7,150,449 | B1 * | 12/2006 | Dueck et al. | 254/278 |
| 7,243,870 | B2 * | 7/2007 | Pook et al. | 242/278 |
| 7,325,785 | B2 * | 2/2008 | Krengel et al. | 254/338 |
| 7,527,242 | B2 * | 5/2009 | Shaha | 254/286 |
| 7,533,869 | B2 | 5/2009 | Boda et al. | |
| 7,963,505 | B2 * | 6/2011 | Taylor et al. | 254/286 |
| 8,056,883 | B1 * | 11/2011 | Brockie | 254/278 |
| 2004/0238804 | A1 * | 12/2004 | Revi | 254/278 |
| 2007/0029267 | A1 | 2/2007 | Hall et al. | |
| 2007/0176524 | A1 | 8/2007 | Plano et al. | |
| 2007/0284560 | A1 | 12/2007 | Maturino | |
| 2011/0127477 | A1 * | 6/2011 | Kokolis | 254/285 |

OTHER PUBLICATIONS http://panofish.net/garage-trailer-lift/comment-page-1/#comments, visited Jan. 16, 2012.

http://www.mygaragestore.com/detail.aspx?ID=777, visited Jan. 16, 2012.

http://www.quadratec.com/products/12020_1000.htm, visited Jan. 16, 2012.

costco.com bike storage advertisement; dated Nov. 1, 2007-Nov. 30, 2007.

* cited by examiner

*Primary Examiner* — Emmanuel M Marcelo
(74) *Attorney, Agent, or Firm* — Vidas, Arrett & Steinkraus, P.A.

(57) ABSTRACT

An assembly for lifting and storing an ice house or other item includes a base and a plurality of horizontal brace members rigidly connected to one another. The assembly further includes an electric winch mounted to the base and a plurality of rollers and pulleys. The rollers are rotatably attached to the base and the pulleys are connected to the horizontal brace members. The assembly includes at least one cable that is routed from the electric winch, past the roller and over the pulley. The cable is attached to the ice house. The ice house is lifted and suspended from a ceiling or an assembly of overhead beams via the electric winch.

4 Claims, 5 Drawing Sheets

48
14
10
22
22
58
58
58
58
46
46
46

STORAGE LIFT

CROSS-REFERENCE TO RELATED APPLICATIONS

None.

STATEMENT REGARDING FEDERALLY SPONSORED RESEARCH

None.

BACKGROUND OF THE INVENTION

Demand for storage space in modern homes and other buildings, and in particular, in garages, is at a premium. These spaces can become cluttered and messy in the absence of organizational tools to help utilize available space. As people accumulate ever increasing quantities of outdoor equipment, the need to organize these spaces becomes more acute.

One outdoor item which has contributed to the need for increased organization is the portable ice house. The use and popularity of portable ice houses has grown over the last decade. New designs and technological advancements in portable ice houses make them more user friendly. The downside of these designs, however, is that they typically require a significant amount of storage space, especially when stored flat.

In light of the foregoing, there remains a need for a device that can utilize unused space, for example, in one's garage.

The art referred to and/or described above is not intended to constitute an admission that any patent, publication or other information referred to herein is "prior art" with respect to this invention. In addition, this section should not be construed to mean that a search has been made or that no other pertinent information as defined in 37 C.F.R. §1.56(a) exists.

All US patents and applications and all other published documents mentioned anywhere in this application are incorporated herein by reference in their entirety.

Without limiting the scope of the invention, a brief summary of some of the claimed embodiments of the invention is set forth below. Additional details of the summarized embodiments of the invention and/or additional embodiments of the invention may be found in the Detailed Description of the Invention below.

BRIEF SUMMARY OF THE INVENTION

In some embodiments, the invention is directed to a storage lift assembly which comprises a base, a plurality of brace members, an electric winch, a plurality of rollers, a plurality of pulleys, and a first cable. The brace members are mechanically linked to one another and to the base. Further, in some embodiments, the electric winch extends from the base. And, the rollers are rotatably attached to the base. In some embodiments, the pulleys are connected to the brace members and the first cable is routed from the electric winch over at least one of the pulleys. The first cable contacts one of the rollers between the electric winch and the pulley.

In some embodiments, the storage lift assembly further comprises a second cable. The second cable extends from the electric winch and over at least one of the pulleys.

In some embodiments, each of the cables has two free ends. At least one of the free ends of each cable has a chain attached thereto.

In some embodiments, each of the cables is connected to a chain via a karabiner.

In some embodiments, the plurality of rollers comprises a first pair of rollers and a second pair of rollers.

In some embodiments, the plurality of pulleys comprises a first pair of pulleys and a second pair of pulleys.

In some embodiments, the rollers of the first pair of rollers are spaced at a distance $R_1$ and the rollers of the second pair of rollers are spaced at a distance $R_2$. In some embodiments, the pulleys of the first pair of pulleys are spaced at a distance $P_1$ and the pulleys of the second pair of pulleys are spaced at a distance $P_2$. In some embodiments, $P_1>R_1$ and $P_2>R_2$.

In some embodiments, the electric winch is attached to a control box.

In some embodiments, the electric winch comprises a direct current motor.

In some embodiments, the invention is directed to a storage lift kit which comprises:

a base;
a brace member;
an electric winch;
a plurality of rollers;
a plurality of pulleys;
at least one cable; and
a control box for operating the electric winch.

In some embodiments, the storage lift kit further comprises a plurality of karabiners.

In some embodiments, the storage lift kit further comprises an instruction manual for assembling the storage lift.

In some embodiments, the storage lift further comprises a chain. In some embodiments, the invention is directed to a storage lift which comprises a base, a plurality of brace members, an electric winch, and a plurality of rollers. Further, in some embodiments, the storage lift comprises a rolling guide, a plurality of pulleys, and first and second cables. In some embodiments, the brace members include central brace members and outboard brace members. The brace members are rigidly connected to one another and the central brace members are attached to the base. In some embodiments, the electric winch extends from the base. In some embodiments, the rollers include a first pair of rollers and a second pair of rollers. The rollers are rotatably attached to the base and extend orthogonally from the base. In some embodiments, the rolling guide is attached to the base and is parallel to the base. In some embodiments, the pulleys are connected to the outboard brace members.

In some embodiments, the first cable has a first section and a second section. The first section of the first cable is routed from the electric winch, between the rollers of the first pair of rollers, and over one of the pulleys. The second section of the first cable is routed from the electric winch, between the rollers of the first pair of rollers, and over another one of the pulleys.

In some embodiments, the second cable has a first section and a second section. The first section of the second cable is routed from the electric winch, over the rolling guide, between the rollers of the second pair of rollers, and over another one of the pulleys. The second section of the second cable is routed from the electric winch, over the rolling guide, between the rollers of the second pair of rollers, and over another one of the pulleys.

In some embodiments, the electric winch is situated between the first pair of rollers and the second pair of rollers.

In some embodiments, the invention is directed to a storage lift that is used in combination with a storage facility. The storage lift is attached to the storage facility. In some embodiments, the storage facility comprises a garage.

In some embodiments, the storage lift is used in combination with an ice house, with the first and second cables being attached to the ice house.

In some embodiments, the storage lift further comprises a battery box attached to the central brace members.

DETAILED DESCRIPTION OF THE INVENTION

Figure 1:
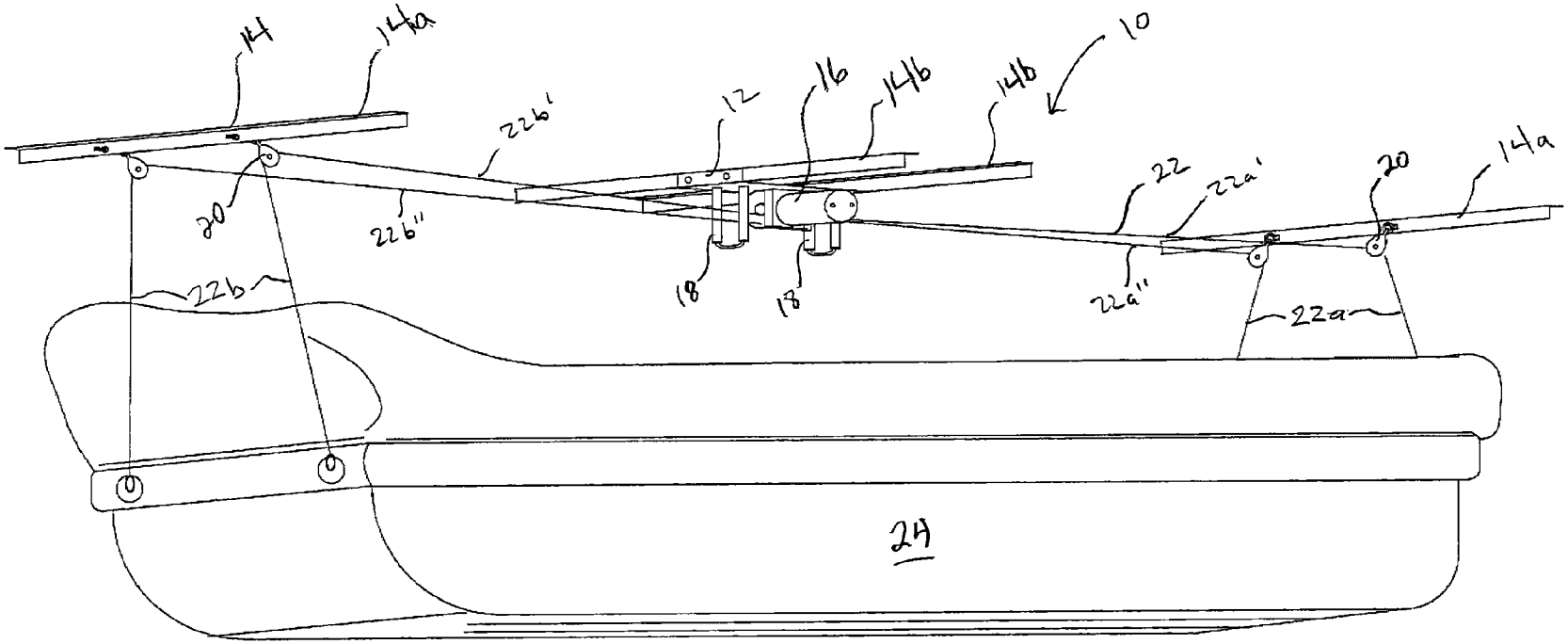
FIG. 1 shows a perspective view of an embodiment of the garage-storage lift assembly and an ice house in a storage-ready configuration.

While this invention may be embodied in many different forms, there are described in detail herein specific embodiments. This description is an exemplification of the principles of the invention and is not intended to limit it to the particular embodiments illustrated.

For the purposes of this disclosure, like reference numerals in the figures shall refer to like features unless otherwise indicated.

An assembly for lifting and storing an ice house 24 or other item is herein disclosed. Shown for example in FIG. 1, the assembly 10 comprises a base 12, a plurality of brace members 14, an electric winch 16, a plurality of rollers 18, a plurality of pulleys 20, and one or more cables 22.

As used herein, the term "ice house" is used herein to refer to such a structure regardless of configuration. For example, the ice house can be assembled, disassembled, folded, prepared for storage, or ready for use.

Generally, the brace members 14 are rigidly mounted to the ceiling of a garage or other structure so that the ice house 24 can be raised via the assembly 10. Additionally, attached to the base 12 are the rollers 18 and pulleys 20. Optionally attached to the base 12 are the brace members 14.

In some embodiments, the assembly 10 comprises outboard brace members 14*a* and central brace members 14*b*. The ice house 24 is generally suspended from the outboard brace members 14*a* while the central brace members 14*b* support the electric winch 16.

Figure 2:
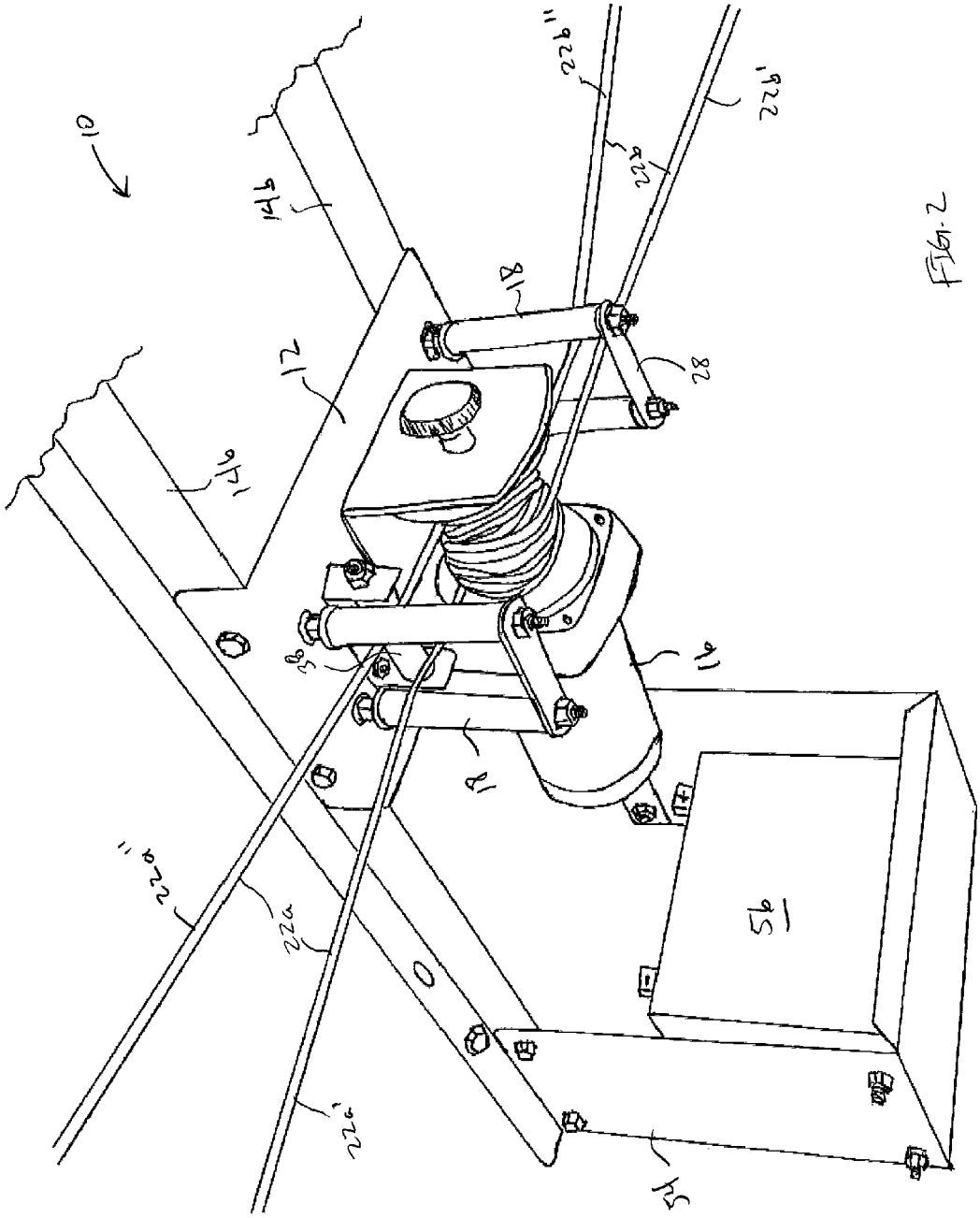
FIG. 2 shows a detailed perspective view of a portion of the garage-storage lift assembly of FIG. 1.

Turning to FIG. 2, the base 12 is shown attached to the central brace members 14*b*. Further, in some embodients, the rollers 18 and electric winch 16 are attached to the base 12. In some embodiments, the rollers 18 extend orthogonally from the base 12. The rollers 18 guide the cable 22 between the winch 16 and the pulleys 20.

Figure 3:
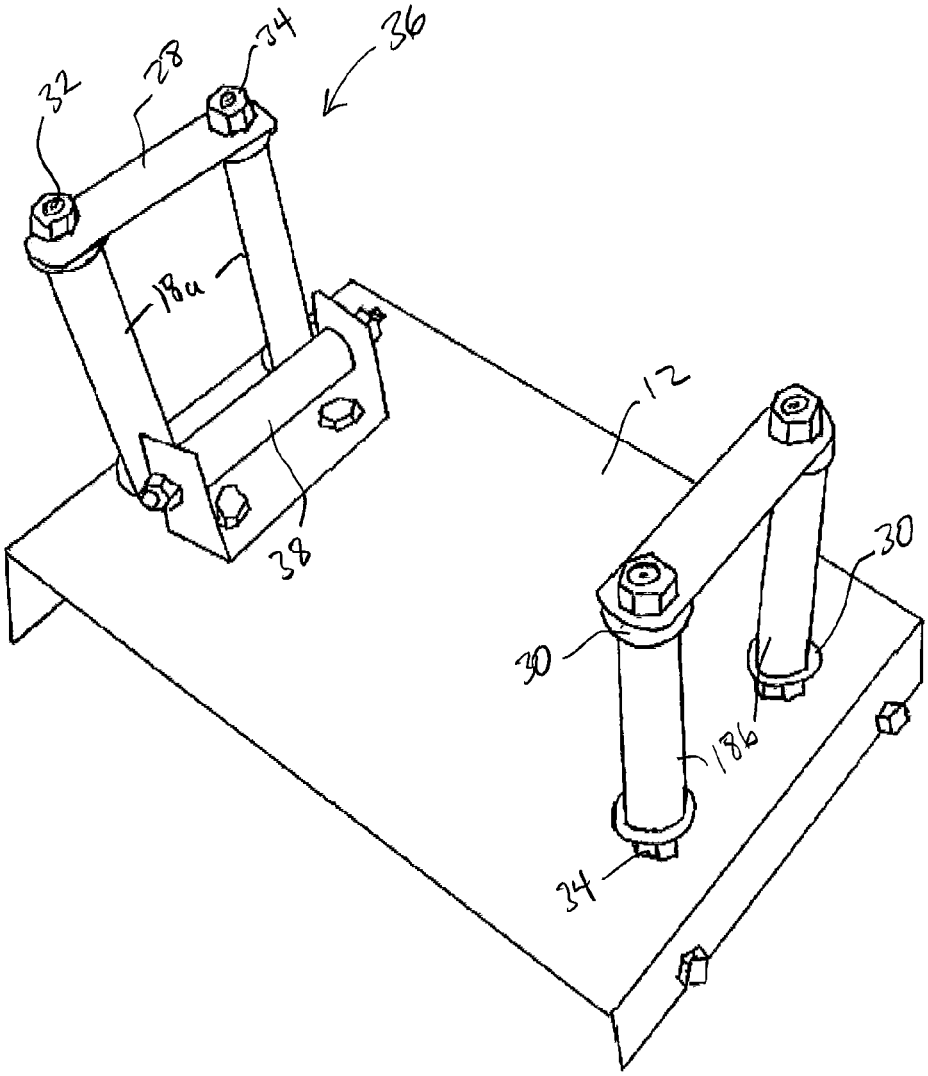
FIG. 3 shows an embodiment of the roller assembly 36.

As shown, for example in FIG. 3, in some embodiments, the rollers 18 comprise a first pair of rollers 18*a* and a second pair of rollers 18*b*. In some embodiments, the rollers 18 are attached to the base 12 via bolts 32 on which nuts 34 are threaded to secure the bolts 32 to the base 12. In some embodiments, a plate 28 is located at the end of the bolts 32. The rollers 18 are located between the plate 28 and the base 12, with washers 30 and nuts 34 disposed on the ends of the rollers 18, as desired. Further, in some embodiments, the rollers 18 are secured on the bolts 32 such that they are permitted to rotate. For example, a nut 34 is threaded onto the bolt 32 but is not fully tightened against the bolt 32. Moreover, to secure the roller assembly 36 to the base 12 (FIG. 3), another nut 34 is threaded onto the bolt 32 to sandwich the base 12 between the head of the bolt (not shown) and the nut 34. In some embodiments, a threaded rod is used in place of bolts 32.

The rollers 18 can be made from any suitable material. In some embodiments, the rollers 18 are made from a metallic material, for example steel. Polymeric materials, rubber, alloys, and composite materials may also be suitable.

With further regard to FIGS. 2 and 3, in some embodiments, the base 12 has attached thereto a rolling guide 38. The rolling guide 38 positions the cable 22 away from the base 12 and aligns it with the electric winch 16 (FIGS. 1 and 2). In some embodiments, the rolling guide 38 is parallel to the base 12. Further, it will be appreciated that in some embodiments, a rolling guide 38 is necessary on only one side of the electric winch 16 as the cables 22 extend from opposing hemispheres of the electric winch 16.

In this regard, and with further reference to FIGS. 1 and 3, in some embodiments, the assembly 10 comprises two cables 22, a first cable 22*a* for lifting one side of the ice house 24 and a second cable 22*b* for lifting the other side of the ice house 24. In some embodiments, for example as shown in FIG. 2, the first cable 22*a* emanates from the top side of the electric winch 16 while the second cable 22*b* emanates from the bottom side of the electric winch 16. This configuration allows the electric winch 16 to raise the ice house 24, simultaneously acting on the first cable 22*a* and the second cable 22*b*.

In some embodiments, the first cable 22*a* comprises a first section 22*a*' and a second section 22*a*". Further, the second cable 22*b* comprises a first section 22*b*' and a second section 22*b*". The cable sections, 22*a*', 22*a*", 22*b*', and 22*b*", are defined as the length of cable extending from the electric winch 16, with the electric winch 16 being the divider between the respective sections.

Figure 4:
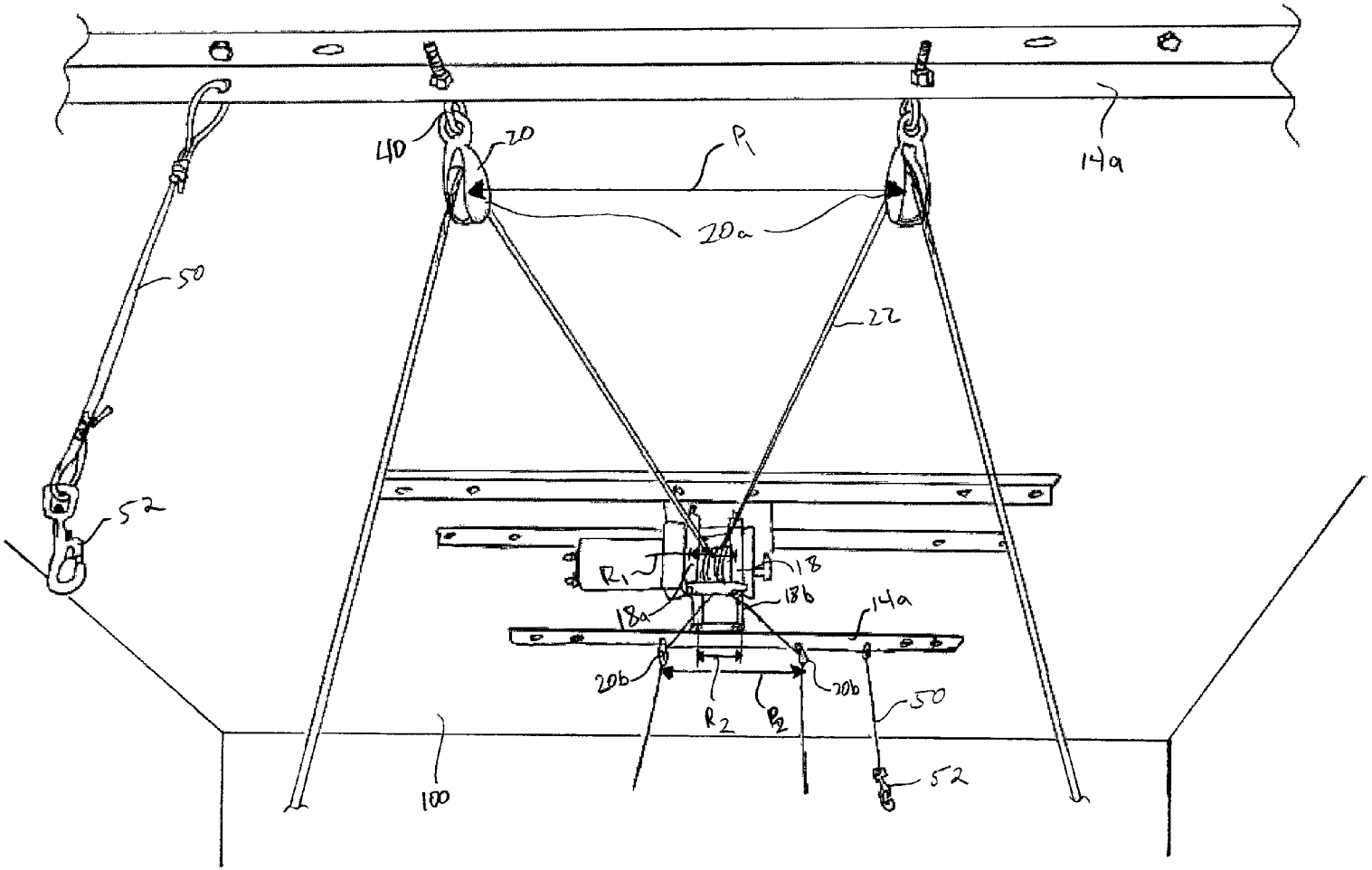
FIG. 4 shows a perspective view of the garage-storage lift assembly of FIG. 1.

Turning to FIG. 4, in some embodiments, the rollers 18 of the second pair of rollers 18*b* are spaced apart from one another at a distance $R_2$. Further, the rollers 18 of the first pair of rollers 18*a* are spaced apart from one another at a distance $R_1$. In some embodiments, $R_1$ is equal to $R_2$.

In some embodiments, the pulleys 20 comprise a first pair of pulleys 20*a* and a second pair of pulleys 20*b*. The pulleys 20 of the first pair of pulleys 20*a* are spaced apart from one another at a distance $P_1$ while the pulleys 20 of the second pair of pulleys 20*b* are spaced apart from one another at a distance $P_2$. In some embodiments, $P_1$ is equal to $P_2$. Further, in some embodiments, $P_1$ is greater than $R_1$ and, in some embodiments, $P_2$ is greater than $R_2$. In this way, the rollers 18 direct the cables 22 from the wider spaced pulleys onto the electric winch 16.

In some embodiments, the pulleys 20 are attached to the outboard brace members 14*a* by way of eye bolts 40. Moreover, in some embodiments, the brace members 14 are secured to the garage ceiling 100 by way of lag bolts.

Figure 5:
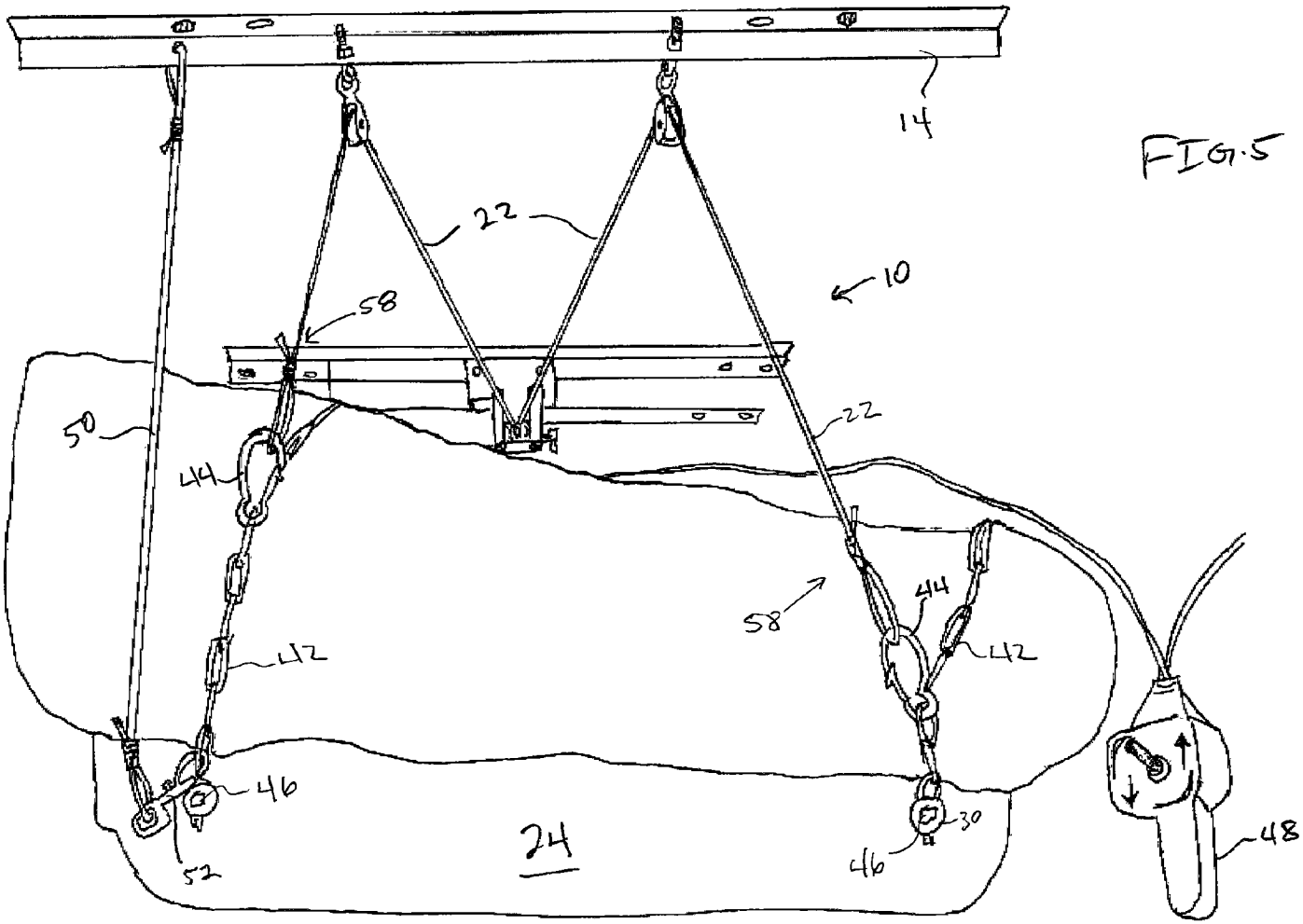
FIG. 5 shows an end view of an ice house, in a storage-ready configuration, that is suspended by the garage-storage lift assembly of FIG. 1.

With reference to FIG. 5, in some embodiments, the cables 22 have chains 42 attached thereto. Each of the cables 22 has two free ends 58 which, in some embodiments, are attached to the chains 42. In some embodiments, the chains 42 are attached to the cables 22 via a karabiner or spring snap 44. Although shown with a karabiner 44 in FIG. 5, other types of hooks, for example s-hooks, or other attachments could also be used. It is also within the scope of the invention for the cable 22 to be hooked directly to the chain 42.

As illustrated via FIG. 5, the ice house 24 can be leveled by way of chains 42 and karabiners 44. The chains 42 are secured to the ice house 24 using fasteners 46. In some embodiments, the fasteners 46 comprise bolts that are inserted through holes in the ice house 24. Desirably, washers 30 are used to distribute the load. As shown in FIG. 5, a washer 30 is placed near the head of the fastener 46 and the fastener 46 is then disposed through one of the last links, desirably the last link, of the chain 42. Thereafter, another washer 30 is added and the fastener 46 is pushed through the hole in the ice house 24. A washer may be added to the end of the fastener protruding into the ice house 24 and a nut threaded onto the end of the fastener 46 and tightened. In some embodiments, it may be necessary to drill holes in the desired location of the ice house 24.

As further shown in FIG. 5, the assembly 10 further comprises a control box 48. In some embodiments, the control box 48 comprises a hand held remote. The control box 48 is connected to the electric winch 16 and has an up button and a down button or other switch or toggle for directing the winch to wind or unwind the cable 22 as desired.

In some embodiments, the assembly 10 has a safety line 50 connected to the chain 42 and the brace member 14. The safety line 50 provides added security in the event of component failure, for example in the cable 22 or electric winch 16. In some embodiments, the safety line 50 comprises a braided wire. Other materials and configurations are also suitable, for example rope or chain. In some embodiments, the safety line 50 has a spring snap, for example a slide-bolt spring snap 52, as shown.

In some embodiments, the electric winch 16 comprises a direct current (D/C) motor. In some embodiments, the DC motor is a 12V type motor that can be operated off of a car battery. Alternatively, the electric winch can use an alternating current (A/C) motor, for example 110V.

In some embodiments, a battery 56, for example 12V, is located in a battery box 54, for example as shown in FIG. 2. In some embodiments, the battery box 54 is attached to the central brace members 14*b*. Other locations are suitable as well. In some embodiments, the electric winch is powered by an A/C to D/C converter. More generally, any suitable power supply may be used.

In some embodiments, the assembly 10 comprises a limit switch that automatically stops the electric winch 16 once the ice house 24 has reached a predetermined height.

In some embodiments, the brace members 14 are drilled to be compatible with both 18 inch and 24 inch truss-spacing. Additionally, in some embodiments, the brace member 14 can be drilled to be compatible with 16 inch, 18 inch, and 24 inch truss-spacing, or any combination of common truss-spacing(s).

In some embodiments, the components of the assembly 10 are sold in a kit, desirably together with an instruction manual for assembling and using the storage lift.

It will be appreciated that the assembly 10 can be used with a variety of ice house types, including popular brands. In this way, the assembly 10 is universal. Further, although herein described with reference to ice house 24, the skilled artisan will appreciate that the assembly 10 can be used with a variety of other products, for example kayaks, boats, boxes, cargo carriers, temporary dwelling, and the like.

The above disclosure is intended to be illustrative and not exhaustive. This description will suggest many variations and alternatives to one of ordinary skill in this art. The various elements shown in the individual figures and described above may be combined or modified for combination as desired. All these alternatives and variations are intended to be included within the scope of the claims where the term "comprising" means "including, but not limited to".

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the invention. Those skilled in the art may recognize other equivalents to the specific embodiment described herein which equivalents are intended to be encompassed by the claims attached hereto.

The invention claimed is:

1. A storage lift comprising:

a base;

a plurality of brace members, including central brace members and outboard brace members, the brace members being rigidly connected to one another, the central brace members being attached to the base;

an electric winch extending from the base;

a plurality of rollers, including a first pair of rollers and a second pair rollers, the rollers being rotatably attached to the base and extending orthogonally from the base;

a rolling guide being attached to the base, the rolling guide being parallel to the base;

a plurality of pulleys, the pulleys connected to the outboard brace members; and a first cable and a second cable, the first cable having a first section and a second section, the first section of the first cable being routed from the electric winch, between the rollers of the first pair of rollers, and over one of the pulleys;

the second section of the first cable being routed from the electric winch, between the rollers of the first pair of rollers, and over another one of the pulleys;

the second cable having a first section and a second section, the first section of the second cable being routed from the electric winch, over the rolling guide, between the rollers of the second pair of rollers, and over another one of the pulleys;

the second section of the second cable being routed from the electric winch, over the rolling guide, between the rollers of the second pair of rollers, and over another one of the pulleys;

wherein the electric winch is situated between the first pair of rollers and the second pair of rollers.

2. In combination, the storage lift of claim 1 and a storage facility, the storage lift being attached to the storage facility.

3. In combination, the storage lift of claim 1 and an ice house, the first and second cables being connected to the ice house.

4. In some embodiments, the storage lift of claim 1 further comprises a battery box attached to at least one of the central brace members.

* * * * *